US011540601B2

(12) United States Patent
Bernard et al.

(10) Patent No.: US 11,540,601 B2
(45) Date of Patent: Jan. 3, 2023

(54) JEWELRY ITEM COMPRISING A THREE-DIMENSIONAL MESH FOR SUPPORTING DECORATIVE ELEMENTS

(71) Applicant: CARTIER INTERNATIONAL AG, Steinhausen (CH)

(72) Inventors: Philippe Bernard, Plailly (FR); Ludovic Provent, St Germain les Arpajon (FR); Aline Guillotin, Paris (FR)

(73) Assignee: CARTIER INTERNATIONAL AG, Steinhausen (CH)

( * ) Notice: Subject to any disclaimer, the term of this patent is extended or adjusted under 35 U.S.C. 154(b) by 0 days.

(21) Appl. No.: 17/253,850

(22) PCT Filed: Jul. 2, 2019

(86) PCT No.: PCT/EP2019/067778
§ 371 (c)(1),
(2) Date: Dec. 18, 2020

(87) PCT Pub. No.: WO2020/007883
PCT Pub. Date: Jan. 9, 2020

(65) Prior Publication Data

US 2021/0321730 A1 Oct. 21, 2021

(30) Foreign Application Priority Data

Jul. 4, 2018 (FR) ..... 18 56163

(51) Int. Cl.
*A44C 17/02* (2006.01)
*A44C 17/04* (2006.01)

(52) U.S. Cl.
CPC ..... *A44C 17/046* (2013.01); *A44C 17/02* (2013.01)

(58) Field of Classification Search
CPC ..... A44C 17/046; A44C 17/02; A44C 1/00; A44C 11/003; A44C 15/00;
(Continued)

(56) References Cited

U.S. PATENT DOCUMENTS 1,499,769 A * 7/1924 Godefroy ..... A44C 11/002 245/1
1,781,687 A * 11/1930 Hazman ..... A44C 25/00 428/23

(Continued)

FOREIGN PATENT DOCUMENTS

GB 1218540 1/1971

OTHER PUBLICATIONS

International Search Report dated Aug. 8, 2019.
Notification of the First Office Action dated Mar. 14, 2022.
Notification of the Second CN Office Action dated Sep. 15, 2022.

*Primary Examiner* — Jack W Lavinder
(74) *Attorney, Agent, or Firm* — Ipsilon USA, LLP

(57) ABSTRACT

The invention relates to a jewelry item (10) comprising:—at least one cable (12) arranged to form a support mesh (14),—a plurality of decorative elements (16) threaded on said at least one cable (12) and shaped to structure the support mesh (14) according to a predetermined three-dimensional profile. The invention also relates to a jewelry assembly comprising at least two jewelry items (10) according to any one of the preceding claims and means for securing the support meshes together.

20 Claims, 2 Drawing Sheets

(58) Field of Classification Search
CPC ... A44C 17/0241; A44C 25/00; A44C 25/007; A44C 11/00; A44C 11/002; Y10T 29/49838
See application file for complete search history.

(56) References Cited

U.S. PATENT DOCUMENTS

| | | | | | |
|---|---|---|---|---|---|
| 1,927,038 | A | * | 9/1933 | Kane | A44C 17/02 24/1 |
| 2,096,337 | A | * | 10/1937 | Pultar | B65D 7/20 29/433 |
| 2,102,746 | A | * | 12/1937 | Reilly | B44C 1/10 83/28 |
| 3,708,862 | A | | 1/1973 | Powell | |
| 3,742,730 | A | * | 7/1973 | Powell, Jr. | D04D 9/00 63/37 |
| 3,931,719 | A | | 1/1976 | Schwab | |
| 4,220,018 | A | | 9/1980 | Chuard | |
| 5,494,734 | A | * | 2/1996 | Widders | D04D 7/02 442/50 |
| 7,269,882 | B2 | | 9/2007 | Kato | |
| 2007/0199346 | A1 | | 8/2007 | Sieradzki | |
| 2013/0236679 | A1 | | 9/2013 | Bizzotto | |

* cited by examiner

JEWELRY ITEM COMPRISING A THREE-DIMENSIONAL MESH FOR SUPPORTING DECORATIVE ELEMENTS

RELATED APPLICATION

This application is a National Phase of PCT/EP2019/067778 filed on Jul. 2, 2019 which claims the benefit of priority from French Patent Application No. 18 56163, filed on Jul. 4, 2018, the entirety of which are incorporated by reference.

FIELD OF THE INVENTION

The present invention relates to a jewelry item comprising a three-dimensional mesh for supporting decorative elements.

DESCRIPTION OF RELATED ART

The document DE 29 19 912 A1 discloses a piece of jewelry comprising gold wires that are wound around themselves in an irregular manner so as to form a sphere. The gold wires are welded to one another by brazing at points of intersection formed by a plurality of segments of wire so as to stiffen the piece of jewelry and maintain the spherical shape thereof. In order to make the shaping of the sphere easier, a molding body may be provided so that the wires are wound around this molding body. Furthermore, balls may be threaded onto one or two gold wires as adornments.

It has been observed that such a piece of jewelry of which the three-dimensional profile is obtained by brazing the wires to one another is very stiff. Specifically, this three-dimensional profile is fixed and confers no flexibility on the piece of jewelry when the latter is handled.

Furthermore, the document U.S. Pat. No. 3,708,862 discloses a piece of jewelry produced by way of a mesh of wires onto which decorative beads are threaded. The wires of the mesh are comprehensively tightened so as to compress all of the beads together in order to obtain a final shape.

Moreover, the document FR 2 876 885 A1 discloses a piece of jewelry that has bezels joined to a plurality of wires so as to produce a grid. The bezels form blind orifices for the introduction of wire ends. Each wire end is welded to the bezel in an orifice in order to achieve cohesion of the assembly. Consequently, it would be useful to design a novel jewelry item comprising a support mesh capable of forming a three-dimensional profile while retaining a certain flexibility.

OBJECTS AND SUMMARY

To this end, the subject of the invention is a jewelry item comprising:

at least one cable arranged so as to form a support mesh, a plurality of decorative elements threaded onto said at least one cable and shaped so as to structure the support mesh with a predetermined three-dimensional profile.

The configuration of this jewelry item is such that the support mesh is more flexible while allowing a structure to be maintained that has a predetermined three-dimensional profile, such as a sphere. In particular, this flexibility is obtained by the fact that the decorative elements are threaded onto said at least one cable and are shaped so as to structure the support mesh.

In this case, it is the decorative elements threaded onto the cable of the support mesh that contribute to the structuring of the three-dimensional profile, unlike a piece of jewelry as described in the document DE 29 19 912 A1 in which the three-dimensional profile is structured only by welding the wires to one another.

The jewelry item is made more flexible so that it can be elastically deformed when a slight pressure is applied thereto, thus giving the user an impression of flexibility and low weight.

According to one embodiment of the jewelry item, said at least one cable comprises at least two segments extending in two distinct directions so as to form at least one crossing of segments, at least one of the decorative elements being threaded onto each of said at least two segments at said at least one crossing of segments.

According to one embodiment of the jewelry item, the latter comprises a first plurality of cables extending in a first direction and a second plurality of cables extending in a second direction transverse to the first direction so as to form the support mesh, a plurality of crossings of segments being formed between the first and second pluralities of cables, each decorative element being jointly threaded onto a first cable of the first plurality of cables and onto a second cable of the second plurality of cables, at a crossing of segments.

According to one embodiment of the jewelry item, each decorative element comprises at least two ducts for the passage of a cable through said decorative element, each passage duct extending in a direction that is transverse relative to the other so as to form a crossing of segments inside the decorative element.

According to one embodiment of the jewelry item, each decorative element comprises means for fastening the decorative element to said at least one cable onto which it is threaded.

According to one embodiment of the jewelry item, each decorative element of a portion of the plurality of decorative elements comprises means for fastening the decorative element to said at least one cable onto which it is threaded, the portion of the plurality of decorative elements preferably forming a quantity equal to or greater than 50% of the plurality of decorative elements.

According to one embodiment of the jewelry item, the fastening means comprise a compression screw that extends transverse to said at least two passage ducts and is configured to compress at least one segment disposed inside one of said passage ducts against the decorative element.

According to one embodiment of the jewelry item, said at least two passage ducts are formed in a single plane so as to form an intersection, the compression screw being configured to compress, at said intersection, at least two segments each extending in one of said passage ducts.

According to one embodiment of the jewelry item, at least two decorative elements that are adjacent along a segment are in contact with one another.

According to one embodiment of the jewelry item, at least two decorative elements that are adjacent along a segment are arranged so as to maintain a predetermined clearance between said at least two decorative elements.

According to one embodiment of the jewelry item, at least two adjacent segments converge toward one another in a convergence direction, the peripheral dimensions of the decorative elements being selectively chosen so as to decrease along said at least two segments in the convergence direction.

According to one embodiment of the jewelry item, the predetermined three-dimensional profile is a sphere portion.

According to one embodiment of the jewelry item, each decorative element comprises a decorative face, each decorative element being threaded onto said at least one cable such that the decorative face is oriented toward the outside of the predetermined three-dimensional profile.

According to one embodiment of the jewelry item, the three-dimensional profile is at least one portion of an external envelope of a volume, forming a hollow space inside the envelope portion.

According to one embodiment of the jewelry item, the arrangement of the support mesh is configured to allow the elastic deformation of a portion of the support mesh under the action of a predetermined force, thus deforming the three-dimensional profile, and the return of said portion when the predetermined force is no longer applied to said portion such that the three-dimensional profile is reformed.

A jewelry assembly is also proposed, comprising at least two jewelry items as described above and means for securing the support meshes to one another.

BRIEF DESCRIPTION OF THE DRAWINGS

Further features and advantages of the invention will become apparent upon reading the following description of preferred embodiments of the invention, which is given by way of example and with reference to the appended drawing.

DETAILED DESCRIPTION

Figure 1:
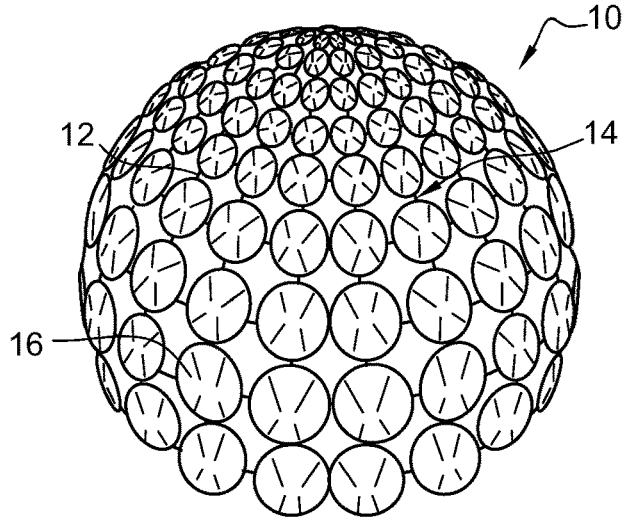
FIGS. 1 and 2 each show a perspective view, one of which is partially exploded, of a jewelry item according to an exemplary embodiment of the invention.
Figure 2:
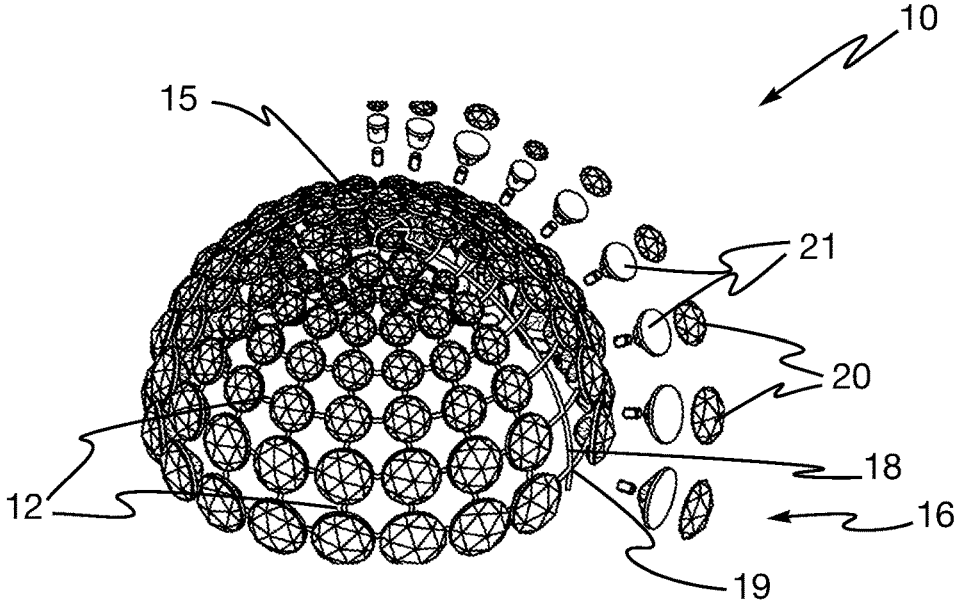

As shown in FIGS. 1 and 2, a jewelry item 10 according to an exemplary embodiment of the invention comprises a plurality of cables 12 arranged so as to form a support mesh 14 and a plurality of decorative elements 16 threaded, i.e. enmeshed, onto the plurality of cables 12. It should be noted that a cable can comprise at least one wire.

The cables 12 may be made from a precious or base metal, nylon or another polymer. The cables 12 may or may not be sheathed. Preferably, the cables 12 are made from a base metal, for example stainless steel, and are sheathed with a coating for example made from white nylon.

"Mesh" is understood here to mean a network of cables or segments extending in at least two different directions and forming a mesh node at each intersection of at least two cables or segments.

Furthermore, "cable" is understood here to mean a thin elongate element, the flexibility of which allows it to be manipulated in order to adopt a curvature or a desired profile. More generally, the cable can be called a wire. The term "cable" is used throughout the present description, but could be replaced by the term "wire" without changing the scope thereof within the meaning of the present disclosure. The cable or wire can be braided, i.e. made up of several strands braided together and extending in a main direction of elongation, or made up of a single solid strand. "Segment" is understood to mean a portion or section of a cable or wire. Preferably, a segment is a portion or section of the wire between two consecutive nodes or a crossing in a mesh.

Each cable 12 comprises a plurality of segments 18 corresponding to a portion of the cable 12 that is disposed between two consecutive nodes 19 of the support mesh 14. More generally, the jewelry item 10 can comprise at least one cable 12 arranged so as to form the support mesh 14. In the latter case, the cable 12 also comprises a plurality of segments 18 between each node 19 of the support mesh 14.

The support mesh 14 can have segments 18 that extend transverse to a surface envelope defined by the support mesh 14.

The plurality of segments 18 preferentially extends in two distinct directions so as to form at least one crossing of segments 18, i.e. a node 19 of the support mesh 14. The two directions of extension of the segments 18 are preferably transverse, even more preferably orthogonal, to one another. The support mesh 14 in FIGS. 1 and 2 defines a partially spherical envelope. Alternatively, the support mesh 14 can define an envelope that has a different profile, such as a geometric or non-geometric profile.

According to the example in FIGS. 1 and 2, a first plurality of cables 12 converge at a joining point 15. Thus, at least two adjacent segments converge toward one another in a direction of convergence toward the joining point 15. A second plurality of cables 12 extending transverse to the first plurality of cables are disposed parallel to one another and form circles with different diameters. In particular, the second plurality of cables 12 form circles of which the diameter increases from the top point 15 as far as the periphery of the support mesh 14.

In other words, the two directions of extension of the segments 18 correspond, in the example in FIGS. 1 and 2, to the longitude and latitude of the spherical profile of the jewelry item 10. Continuing this geographical analogy, the cables 12 preferably form parallels and meridians of the support mesh 14.

The nodes 19 of the support mesh 14 are each formed at an intersection of a segment 18 extending in a first direction with another segment extending in the second direction transverse to the first direction. In other words, the nodes 19 of the support mesh 14 are thus each formed at an intersection of a longitude and a latitude when the support mesh defines a spherical surface.

The decorative elements 16 are threaded onto the cables 12 and shaped so as to structure the support mesh 14 with a predetermined three-dimensional profile. Three-dimensional profile is understood to mean an external envelope or envelope portion of a volume. The three-dimensional profile therefore preferably defines a hollow or empty space within itself. The support mesh 14 thus preferably forms a two-dimensional surface that defines the three-dimensional external envelope or envelope portion of a volume. Therefore, an empty space inside the three-dimensional profile is formed. The configuration of the decorative elements 16 and the cables 12 makes it possible to maintain cohesion of the support mesh 14 that allows the three-dimensional profile to be maintained without a reinforcing element in the space inside the three-dimensional profile. The arrangement of the support mesh 14 thus makes it possible to dispose the decorative elements 16 only around the periphery of the three-dimensional profile so as to obtain a jewelry item 10 that is perceived to be more structured.

Furthermore, a smaller number of decorative elements 16 are needed to produce the three-dimensional profile compared with a solution in which the decorative elements 16 are compressed against one another to produce a three-dimensional structure.

In the example in FIGS. 1 and 2, this predetermined three-dimensional profile is a sphere portion, in particular a hemisphere. Alternatively, the predetermined three-dimensional profile can be any three-dimensional profile of which the outer surface can be defined by a support mesh 14.

"Structure" is understood to mean the fact that the shaping of the decorative elements 16 and their cooperation with the cables 12 allow the shaping, and the maintaining in shape, of the support mesh 14 following the predetermined three-dimensional profile. In other words, the arrangement of the decorative elements 16 with the cables 12 allows a two-dimensional support mesh 14 to be shaped following a three-dimensional profile. Thus, the support mesh 14 and the decorative elements 16 form a full-surface or near-full-surface envelope of the predetermined three-dimensional profile.

In order to allow the decorative elements 16 to structure the support mesh 14 following the predetermined three-dimensional profile, the decorative elements 16 are configured to participate in positioning and maintaining in position the nodes 19 of the support mesh 14. To this end, the decorative elements 16 are preferably threaded or enmeshed onto at least two segments 18. In particular, the decorative elements 16 are preferably disposed at an intersection or a crossing of at least two segments 18, i.e. at a node 19 of the support mesh 14.

Figure 3:
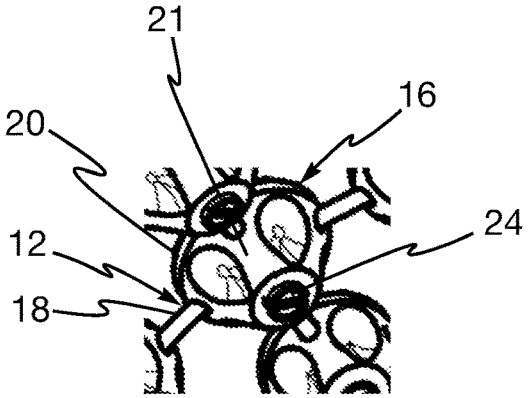
FIGS. 3 and 4 each show a detailed perspective view, one of which is partially exploded, of a decorative element of the jewelry item in FIGS. 1 and 2.
Figure 4:
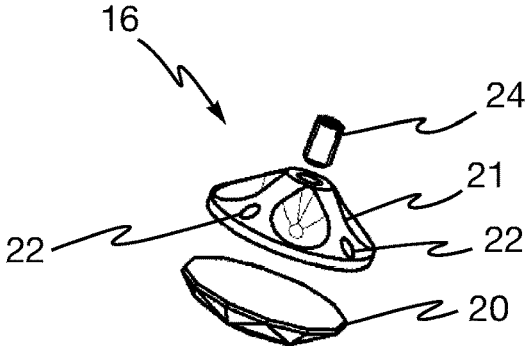

In order to thread or enmesh the decorative elements 16 onto or into the cables 12, each decorative element 16 may comprise at least two ducts 22 for the passage of a cable 12 through said decorative element 16, as is visible in FIGS. 3 and 4. Each passage duct 22 preferably extends in a direction that is transverse relative to the other so as to form a crossing of segments 18 inside the decorative element 16.

The two passage ducts 22 may be formed in a single plane. In other words, the two passage ducts 22 form an intersection such that they are in communication with one another. Producing the two passage ducts 22 in a single plane allows the support mesh 14 to be thin since the segments 18 cross substantially in a single plane. In practice, the segments 18 overlap at the intersection of the passage ducts 22 while extending inside the passage ducts 22 that are produced in a single plane.

Producing a thin support mesh 14 makes it possible to guarantee the support mesh 14 flexibility when it is handled. The support mesh 14 and the decorative elements are configured to allow elastic deformation of the support mesh 14 when the jewelry item 10 is handled. The support mesh 14 can therefore be deformed at discrete points, in particular at a node 19, and return to its predetermined three-dimensional profile when the pressure is no longer exerted. The jewelry item 10 therefore gives the wearer an impression of flexibility and low weight.

Alternatively, the passage ducts 22 may extend in different planes spaced apart from one another.

In order to hold the segments 18 inside the decorative elements 16, the jewelry item 10 preferably comprises means for fastening the decorative elements 16 to the segments 18 onto which they are threaded.

The presence of fastening means at the decorative elements makes it possible to precisely position each decorative element on the support mesh. It is thus possible to locally vary the density of decorative elements on the support mesh, for example when it is desired to obtain a support mesh that has curvatures. Specifically, a variation in the density of decorative elements associated with a variation in the size of the decorative elements allows an improved visual effect to be obtained, in particular by producing a more uniform decoration.

Furthermore, the fastening means make it possible to fasten a plurality of segments of said cable or wire so as to be able to form a crossing or a node of the support mesh. Fastening these crossings or nodes allows cohesion of the support mesh to be maintained and the flexibility of this support mesh to be varied. Specifically, by locally increasing the number of crossings, it is possible to locally stiffen the support mesh. Conversely, a smaller number of crossings makes it possible to locally increase the flexibility of the support mesh. It is thus possible to adjust the flexibility of the support mesh while retaining good cohesion thereof, in particular by maintaining the three-dimensional profile.

The fastening means are preferably disposed on a face opposite a decorative face of the decorative element 16 so as to form a decorative top portion and a functional bottom portion for fastening to the segments 18. Thus, the segments 18 cross beneath the decorative elements 16 so as to conceal the segments 18 as much as possible. This makes it possible to obtain a jewelry item 10 that primarily shows the decorative faces 24.

According to one embodiment, only some of the decorative elements 16 are equipped with fastening means. The decorative elements 16 that have no fastening means therefore only have said at least two passage ducts 22 for allowing the passage, or even the crossing, of the segments 18 inside the decorative elements in order to maintain the cohesion of the support mesh 14. In other words, the segments 18 can slide inside the decorative elements 16 that have no fastening means. The partial absence of fastening means makes it possible to reduce the mass of the jewelry item 10. Preferably, the number of decorative elements 16 that have no fastening means is less than half, i.e. 50%, of the plurality of decorative elements 16. Even more preferably, the number of decorative elements 16 that have no fastening means is equal to or less than 40% or 30% of the plurality of decorative elements 16.

The fastening means comprise for example a compression screw 24 that extends transverse to said at least two passage ducts 22. The compression screw 24 is configured to compress at least one segment 18 disposed inside one of said passage ducts 22 against a part of the decorative element 16. When the passage ducts 22 are produced in a single plane, the compression screw 24 is preferably configured to compress, at said intersection of the passage ducts 22, at least two segments 18 that each extend in one of said passage ducts 22. The compression screw 24 preferably extends perpendicular to the passage ducts 22. Thus, the fact that the passage ducts 22 are formed in a single plane also makes it possible to fasten several segments 18 with a single fastening means, if appropriate a single compression screw 24.

The decorative elements that have no fastening means therefore have no compression screw 24 and no tapped hole for introducing this compression screw 24. Furthermore, the decorative elements 16 that have no fastening means preferably have a thinner bezel than the decorative elements 16 that have fastening means, so as to further reduce the mass of the jewelry item 10.

In order to improve the fastening of the segments 18 in the decorative element 16, an additional product can be inserted around the compression screw 24 so as to reduce the risk of loosening. This additional product is for example a fluid locking product known by the name "Loctite" (registered trademark), also called "threadlocker".

Furthermore, the peripheral dimensions of the decorative elements 16 may be variable. In other words, the peripheral dimensions or the geometry of the decorative elements 16 may be selectively chosen to suit the predetermined three-dimensional profile. Thus, if the predetermined three-dimensional profile has a convex portion, the peripheral dimensions of the decorative elements 16 may be selectively chosen so as to decrease in the direction of this convex portion. Conversely, if the predetermined three-dimensional profile has a concave portion, the peripheral dimensions of the decorative elements 16 may be selectively chosen so as to increase in the direction of this convex portion.

In the example that is visible in FIGS. 1 and 2, the peripheral dimensions of the decorative elements 16 are selectively chosen so as to decrease along the cables 12 that converge toward the joining point 15. Thus, it is possible to thread a constant number of decorative elements 16 onto each circle formed by the second plurality of cables 12 despite the fact that the space between the nodes 19 decreases from one circle to the next in the direction of the joining point 15.

In order to allow better structuring of the support mesh 14, at least two decorative elements 16 that are adjacent along a segment 18 may be in contact with one another. Preferably, the peripheral dimensions of the decorative elements 16 are configured so that each decorative element is in contact with the decorative elements that are adjacent thereto. Bringing the decorative elements into contact with one another in this way allows the integrity of the predetermined three-dimensional profile to be improved by limiting the movement of the decorative elements after they have been mounted on the support mesh 14. Furthermore, bringing the decorative elements into contact in this way makes it easier to assemble the jewelry item 10 by previously defining the positions of the decorative elements 16 relative to one another.

Alternatively or in combination, at least two decorative elements 16 that are adjacent along a segment 18 may be arranged so as to maintain a predetermined space or clearance between said at least two decorative elements 16. Thus, said at least two decorative elements 16 are not in contact with one another. The clearance or space can be maintained either by fastening means integrated into the two decorative elements, or by the action of means for fastening decorative elements 16 that are adjacent to said at least two decorative elements 16. Specifically, the holding of a segment 18 by fastening means downstream or upstream of a given decorative element 16 makes it possible to block or limit the sliding of said decorative element 16 in a direction transverse to the segment 18. Thus, it is possible to maintain the position of decorative elements 16 that have no fastening means in order to maintain a clearance between two decorative elements 16.

Moreover, each decorative element 16 has a decorative face 20 mounted on a body 21, also called a bezel. This decorative face 20 is preferably a precious stone, for example a diamond. The stone can be mounted on the bezel by any appropriate means, such as adhesive bonding or brazing. Each decorative element 16 is preferably threaded or enmeshed onto a cable 12 such that the decorative face 20 is oriented toward the outside of the predetermined three-dimensional profile. In other words, all of the decorative faces 20 are preferably disposed on a single side of the support mesh 14 so as to produce a decorative surface that is more or less continuous. Each decorative face 20 preferably has peripheral dimensions similar to those of the body 21 on which it is disposed. Alternatively, the peripheral dimensions of the decorative faces 20 can be greater than the peripheral dimensions of the body 21 on which they are disposed so as to extend beyond the body 21 so as to at least partially hide it.

Figure 5:
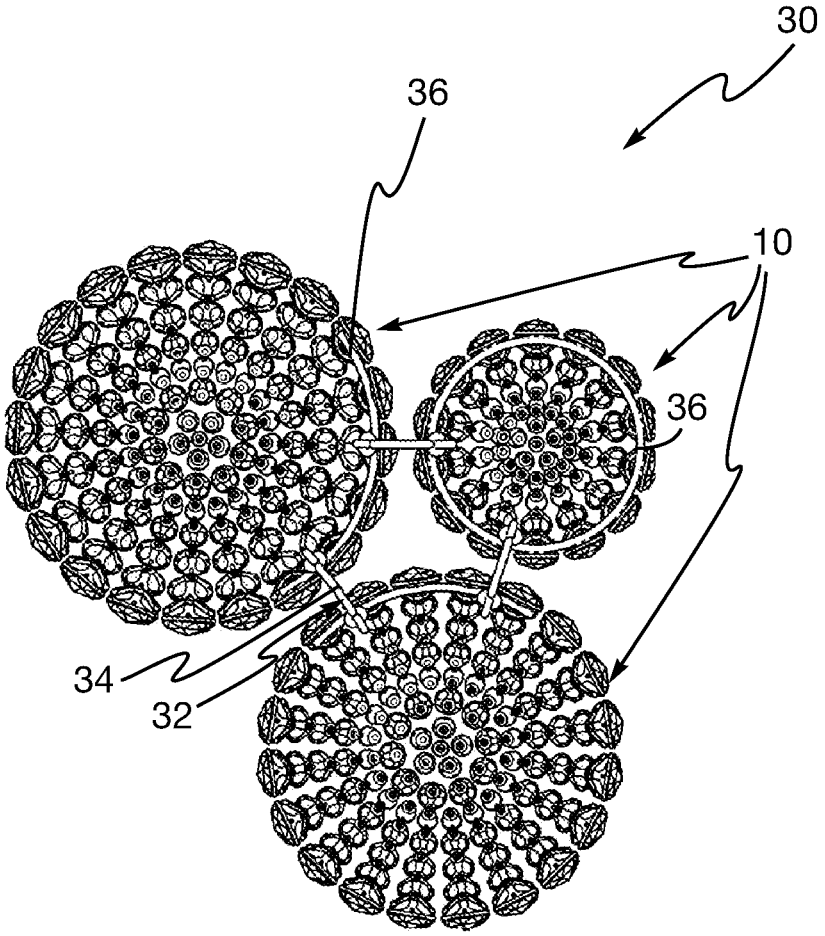
FIG. 5 shows a perspective view of an exemplary embodiment of a jewelry assembly comprising a plurality of jewelry items in FIGS. 1 and 2.

As is visible in FIG. 5, a plurality of jewelry items 10 according to the invention can be joined together to form a jewelry assembly 30. In this case, the jewelry assembly 30 comprises means 32 for securing the support meshes 14 to one another. The securing means 32 preferably have a rod 34 that secures the support meshes 14 of at least two jewelry items 10 to one another. Preferably, the rod 34 is secured to a circle of the second plurality of cables 12. Even more preferably, the circle to which the rod 34 is secured is preferably the circle of the jewelry item 10 that has the greatest diameter.

Each support mesh 14 may comprise a reinforced joining portion 36 that extends partially or completely along a circle of the second plurality of cables 12. The circle along which the reinforced joining portion 36 extends is preferably the circle of the jewelry item 10 that has the greatest diameter. The rod 34 preferably extends between two reinforced joining portions 36 so as to secure two jewelry items 10 to one another.

The invention claimed is:

1. A jewelry item comprising:

at least one cable arranged so as to form a support mesh, a plurality of decorative elements threaded onto said at least one cable and shaped so as to structure the support mesh with a predetermined three-dimensional profile wherein at least some of the decorative elements comprise a fastener that fastens that decorative element to said at least one cable onto which it is threaded.

2. The jewelry item as claimed in claim 1, wherein said at least one cable comprises at least two segments extending in two distinct directions so as to form at least one crossing of segments, at least one of the decorative elements being threaded onto each of said at least two segments at said at least one crossing of segments.

3. The jewelry item as claimed in claim 2, comprising a first plurality of cables extending in a first direction and a second plurality of cables extending in a second direction transverse to the first direction so as to form the support mesh, a plurality of crossings of segments being formed between the first and second pluralities of cables, each decorative element being jointly threaded onto a first cable of the first plurality of cables and onto a second cable of the second plurality of cables, at a crossing of segments.

4. The jewelry item as claimed in claim 1, wherein each decorative element comprises at least two ducts for the passage of a cable through said decorative element, each passage duct extending in a direction that is transverse relative to the other so as to form a crossing of segments inside the decorative element.

5. The jewelry item as claimed in claim 1, wherein each decorative element comprises a fastener.

6. The jewelry item as claimed in claim 5, wherein each decorative element comprises at least two ducts for the passage of a cable through said decorative element, each passage duct extending in a direction that is transverse relative to the other so as to form a crossing of segments inside the decorative element, wherein said at least two passage ducts are formed in a single plane so as to form an intersection, a compression screw being configured to compress, at said intersection, at least two segments each extending in one of said passage ducts.

7. The jewelry item as claimed in claim 1, wherein each decorative element of a portion of the plurality of decorative elements comprises a fastener so that only some of the decorative elements of the jewelry item comprise a fastener.

8. The jewelry item as claimed in claim 7, wherein the portion of the plurality of decorative elements is equal to or greater than 50% of the plurality of decorative elements.

9. The jewelry item as claimed in claim 1, wherein each decorative element comprises at least two ducts for the passage of a cable through said decorative element, each passage duct extending in a direction that is transverse relative to the other so as to form a crossing of segments inside the decorative element, wherein the fastener comprises a compression screw that extends transverse to said at least two passage ducts and is configured to compress at least one segment disposed inside one of said passage ducts against the decorative element.

10. The jewelry item as claimed in claim 1, wherein at least two decorative elements that are adjacent along a segment are in contact with one another.

11. The jewelry item as claimed in claim 1, wherein at least two decorative elements that are adjacent along a segment are arranged so as to maintain a predetermined clearance between said at least two decorative elements.

12. The jewelry item as claimed in claim 1, wherein at least two adjacent segments converge toward one another in a convergence direction, peripheral dimensions of the decorative elements being selectively chosen so as to decrease along said at least two segments in the convergence direction.

13. The jewelry item as claimed in claim 1, wherein the predetermined three-dimensional profile is a sphere portion.

14. The jewelry item as claimed in claim 1, wherein each decorative element comprises a decorative face, and wherein the three-dimensional profile is at least one portion of an external envelope of a volume, each decorative element being threaded onto said at least one cable such that the decorative face is oriented toward the outside of the external envelope portion of the volume.

15. The jewelry item as claimed in claim 1, wherein the three-dimensional profile is at least one portion of an external envelope of a volume, forming a hollow space inside the external envelope portion.

16. The jewelry item as claimed in claim 15, wherein an arrangement of the support mesh is configured to allow elastic deformation of a portion of the support mesh under action of a predetermined force, thus deforming the three-dimensional profile, and return of said portion when the predetermined force is no longer applied to said portion such that the three-dimensional profile is reformed.

17. A jewelry assembly comprising at least two jewelry items as claimed in claim 1 and means for securing the support meshes to one another.

18. A jewelry item comprising:

at least one cable arranged so as to form a support mesh, a plurality of decorative elements threaded onto said at least one cable and shaped so as to structure the support mesh with a predetermined three-dimensional profile, wherein each decorative element comprises means for fastening the decorative element to said at least one cable onto which it is threaded.

19. A jewelry item comprising:

at least one cable arranged so as to form a support mesh, a plurality of decorative elements threaded onto said at least one cable and shaped so as to structure the support mesh with a predetermined three-dimensional profile, wherein each decorative element of a portion of the plurality of decorative elements comprises means for fastening the decorative element to said at least one cable onto which it is threaded, so that only some of the decorative elements of the jewelry item comprise fastening means.

20. The jewelry item as claimed in claim 19, wherein the portion of the plurality of decorative elements is equal to or greater than 50% of the plurality of decorative elements.

* * * * *